US011149661B2

(12) United States Patent
Nakano

(10) Patent No.: US 11,149,661 B2
(45) Date of Patent: Oct. 19, 2021

(54) VARIABLE COMBUSTION CYLINDER RATIO CONTROL METHOD AND VARIABLE COMBUSTION CYLINDER RATIO CONTROL DEVICE

(71) Applicant: TOYOTA JIDOSHA KABUSHIKI KAISHA, Toyota (JP)

(72) Inventor: Tomohiro Nakano, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 300 days.

(21) Appl. No.: 15/813,875

(22) Filed: Nov. 15, 2017

(65) Prior Publication Data

US 2018/0171880 A1 Jun. 21, 2018

(30) Foreign Application Priority Data

Dec. 16, 2016 (JP) ..... JP2016-244468
Jul. 7, 2017 (JP) ..... JP2017-133752

(51) Int. Cl.

| | |
|---|---|
| ***F02D 17/02*** | (2006.01) |
| ***F02D 41/00*** | (2006.01) |
| ***F02D 41/30*** | (2006.01) |
| ***F02D 1/02*** | (2006.01) |
| *F02D 9/02* | (2006.01) |

(52) U.S. Cl.

CPC ..... *F02D 17/02* (2013.01); *F02D 1/02* (2013.01); *F02D 41/0085* (2013.01); *F02D 41/0087* (2013.01); *F02D 41/3058* (2013.01); *F02D 2009/0235* (2013.01)

(58) Field of Classification Search

CPC ..... F02D 1/02; F02D 17/02; F02D 41/0085; F02D 41/0087; F02D 41/3058; F02D 2009/0235; F02D 13/06; F02D 2041/0012

See application file for complete search history.

(56) References Cited

U.S. PATENT DOCUMENTS

| | | | | |
|---|---|---|---|---|
| 9,200,575 | B2 | 12/2015 | Shost | |
| 2005/0199220 | A1 | 9/2005 | Ogiso | |
| 2012/0116647 | A1 | 5/2012 | Pochner et al. | |
| 2014/0053802 | A1* | 2/2014 | Rayl | F02D 41/0087 123/350 |

(Continued)

FOREIGN PATENT DOCUMENTS

| | | | |
|---|---|---|---|
| CN | 102454493 | A | 5/2012 |
| DE | 10 2013217406 | A1 | 3/2014 |

(Continued)

*Primary Examiner* — Hung Q Nguyen
*Assistant Examiner* — Mark L. Greene
(74) *Attorney, Agent, or Firm* — Oliff PLC

(57) ABSTRACT

A variable combustion cylinder ratio control method variably controls a combustion cylinder ratio of an engine during an intermittent deactivation operation, in which cylinder deactivation is intermittently performed. The method includes, when setting N to an integer greater than or equal to 1, repeatedly performing a cylinder deactivation in a pattern in which combustion is consecutively performed in N cylinders in the order of cylinders entering a combustion stroke, and then a subsequent cylinder is deactivated. The method further includes changing the combustion cylinder ratio by changing the pattern such that the value of N is changed by one at a time.

3 Claims, 5 Drawing Sheets

(56) References Cited

U.S. PATENT DOCUMENTS

| | | | | |
|---|---|---|---|---|
| 2014/0053804 | A1* | 2/2014 | Rayl | F02D 41/0087 123/350 |
| 2014/0069377 | A1* | 3/2014 | Brennan | F02D 41/0002 123/350 |
| 2014/0069378 | A1 | 3/2014 | Burleigh et al. | |
| 2014/0090623 | A1* | 4/2014 | Beikmann | F02D 13/06 123/350 |
| 2014/0261316 | A1* | 9/2014 | Shost | F02D 17/02 123/349 |

FOREIGN PATENT DOCUMENTS

| | | | |
|---|---|---|---|
| GB | 2484528 | A | 4/2012 |
| JP | H10-82334 | A | 3/1998 |
| JP | 2005-256664 | A | 9/2005 |
| JP | 2008-115714 | A | 5/2008 |

* cited by examiner

Fig.7

| Combustion cylinder ratio | ID | Deactivation (–) / Combustion (○) | | | | | | | | | | | | | | | | | | | | | | |
|---|---|---|---|---|---|---|---|---|---|---|---|---|---|---|---|---|---|---|---|---|---|---|---|---|
| | | #1 | #3 | #4 | #2 | #1 | #3 | #4 | #2 | #1 | #3 | #4 | #2 | #1 | #3 | #4 | #2 | #1 | #3 | #4 | #2 | #1 | #3 | … |
| 0% (All-Cylinder Deactivation) | (0) | – | – | – | – | – | – | – | – | – | – | – | – | – | – | – | – | – | – | – | – | – | – | … |
| 50%(=1/2) | 1 | ○ | – | ○ | – | ○ | – | ○ | – | ○ | – | ○ | – | ○ | – | ○ | – | ○ | – | ○ | – | ○ | – | … |
| 67%(=2/3) | 2 | ○ | ○ | – | ○ | ○ | – | ○ | ○ | – | ○ | ○ | – | ○ | ○ | – | ○ | ○ | – | ○ | ○ | – | ○ | … |
| 75%(=3/4) | 3 | ○ | ○ | ○ | – | ○ | ○ | ○ | – | ○ | ○ | ○ | – | ○ | ○ | ○ | – | ○ | ○ | ○ | – | ○ | ○ | … |
| 80%(=4/5) | 4 | ○ | ○ | ○ | ○ | – | ○ | ○ | ○ | ○ | – | ○ | ○ | ○ | ○ | – | ○ | ○ | ○ | ○ | – | ○ | ○ | … |
| 83%(=5/6) | 5 | ○ | ○ | ○ | ○ | ○ | – | ○ | ○ | ○ | ○ | ○ | – | ○ | ○ | ○ | ○ | ○ | – | ○ | ○ | ○ | ○ | … |
| 86%(=6/7) | 6 | ○ | ○ | ○ | ○ | ○ | ○ | – | ○ | ○ | ○ | ○ | ○ | ○ | – | ○ | ○ | ○ | ○ | ○ | ○ | – | ○ | … |
| 88%(=7/8) | 7 | ○ | ○ | ○ | ○ | ○ | ○ | ○ | – | ○ | ○ | ○ | ○ | ○ | ○ | ○ | – | ○ | ○ | ○ | ○ | ○ | ○ | … |
| 100% (All-Cylinder Combustion) | (8) | ○ | ○ | ○ | ○ | ○ | ○ | ○ | ○ | ○ | ○ | ○ | ○ | ○ | ○ | ○ | ○ | ○ | ○ | ○ | ○ | ○ | ○ | … |

Fig.8

| Combustion cylinder ratio | ID | Deactivation (–) / Combustion (○) | | | | | | | | | | | | | | | | | | | | | | | |
|---|---|---|---|---|---|---|---|---|---|---|---|---|---|---|---|---|---|---|---|---|---|---|---|---|---|
| | | #1 | #2 | #3 | #4 | #5 | #6 | #1 | #2 | #3 | #4 | #5 | #6 | #1 | #2 | #3 | #4 | #5 | #6 | #1 | #2 | #3 | #4 | #5 | #6 | … |
| 0% | (0) | – | – | – | – | – | – | – | – | – | – | – | – | – | – | – | – | – | – | – | – | – | – | – | – | … |
| 33%(1/3) | 1 | ○ | – | – | ○ | – | – | ○ | – | – | ○ | – | – | ○ | – | – | ○ | – | – | ○ | – | – | ○ | – | – | … |
| 50%(2/4) | 2 | ○ | ○ | – | – | ○ | ○ | – | – | ○ | ○ | – | – | ○ | ○ | – | – | ○ | ○ | – | – | ○ | ○ | – | – | … |
| 60%(3/5) | 3 | ○ | ○ | ○ | – | – | ○ | ○ | ○ | – | – | ○ | ○ | ○ | – | – | ○ | ○ | ○ | – | – | ○ | ○ | ○ | – | … |
| 67%(4/6) | 4 | ○ | ○ | ○ | ○ | – | – | ○ | ○ | ○ | ○ | – | – | ○ | ○ | ○ | ○ | – | – | ○ | ○ | ○ | ○ | – | – | … |
| 71%(5/7) | 5 | ○ | ○ | ○ | ○ | ○ | – | – | ○ | ○ | ○ | ○ | ○ | – | – | ○ | ○ | ○ | ○ | ○ | – | – | ○ | ○ | ○ | … |
| 75%(6/8) | 6 | ○ | ○ | ○ | ○ | ○ | ○ | – | – | ○ | ○ | ○ | ○ | ○ | ○ | – | – | ○ | ○ | ○ | ○ | ○ | ○ | – | – | … |
| 78%(7/9) | 7 | ○ | ○ | ○ | ○ | ○ | ○ | ○ | – | – | ○ | ○ | ○ | ○ | ○ | ○ | ○ | – | – | ○ | ○ | ○ | ○ | ○ | ○ | |
| 80%(8/10) | 8 | ○ | ○ | ○ | ○ | ○ | ○ | ○ | ○ | – | – | ○ | ○ | ○ | ○ | ○ | ○ | ○ | ○ | – | – | ○ | ○ | ○ | ○ | |
| 82%(9/11) | 9 | ○ | ○ | ○ | ○ | ○ | ○ | ○ | ○ | ○ | – | – | ○ | ○ | ○ | ○ | ○ | ○ | ○ | ○ | ○ | – | – | ○ | ○ | |
| 83%(10/12) | 10 | ○ | ○ | ○ | ○ | ○ | ○ | ○ | ○ | ○ | ○ | – | – | ○ | ○ | ○ | ○ | ○ | ○ | ○ | ○ | ○ | ○ | – | – | … |
| 100% | (11) | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | … |

VARIABLE COMBUSTION CYLINDER RATIO CONTROL METHOD AND VARIABLE COMBUSTION CYLINDER RATIO CONTROL DEVICE

BACKGROUND OF THE INVENTION

The present invention relates to a variable combustion cylinder ratio control method and device that variably control the combustion cylinder ratio of an engine during an intermittent deactivation operation, in which cylinder deactivation is intermittently performed.

U.S. Pat. No. 9,200,575 has disclosed a method for variably controlling a combustion cylinder ratio. In this method, various combustion cylinder ratios are achieved by not fixing cylinders that perform combustion and cylinders that are deactivated. The combustion cylinder ratio is calculated by the following expression.

Combustion Cylinder Ratio=Number of Combustion Cylinders/(Number of Combustion Cylinders+Number of Deactivated Cylinders)

The above publication discloses one example of a cylinder deactivation pattern for achieving a predetermined combustion cylinder ratio. In this example, one cylinder is deactivated after combustion is consecutively performed in five cylinders. Thereafter, combustion is performed in one cylinder, and then one cylinder is deactivated. The cylinder deactivation performed in this pattern sets the combustion cylinder ratio to 0.75 (0.75=⅘). This pattern of cylinder deactivation includes a period in which the cylinder deactivation interval is equivalent to five cylinders and a period in which the cylinder deactivation interval is equivalent to one cylinder.

The engine speed temporarily drops in correspondence with cylinder deactivation. The amount of increase in the engine speed after cylinder deactivation is large in a period where the cylinder deactivation interval is long and is small in a period where the interval is short. Therefore, if there are periods where the cylinder deactivation interval is long and periods where the cylinder deactivation interval is short, the fluctuation of the engine speed increases. In order to reduce the engine speed fluctuation, individual torque management is required for each cylinder, That is, in a period where the cylinder deactivation interval is short, the torque generation amount of each of the cylinders that perform combustion must be made larger than that in the period where the cylinder deactivation interval is long, so that the amount of increase in the engine speed until the subsequent cylinder deactivation is made uniform.

Furthermore, when the combustion cylinder ratio is variably controlled, the pattern of cylinder deactivation changes in accordance with changes in that ratio. This complicates the individual torque management for each cylinder, which is performed to reduce engine speed fluctuation.

SUMMARY OF THE INVENTION

Accordingly, it is an objective of the present invention to provide a variable combustion cylinder ratio control method and device that are capable of reducing engine speed fluctuation that is caused by changes in a cylinder deactivation interval when a combustion cylinder ratio is variably controlled.

To achieve the foregoing objective, a variable combustion cylinder ratio control method is provided that is adapted to variably control a combustion cylinder ratio of an engine during an intermittent deactivation operation, in which cylinder deactivation is intermittently performed. The method includes, when setting N to an integer greater than or equal to I, repeatedly performing a cylinder deactivation in a pattern in which combustion is consecutively performed in N cylinders in the order of cylinders entering a combustion stroke, and then a subsequent cylinder is deactivated, In this method, N represents an integer greater than or equal to one. In this case, the combustion cylinder ratio of the engine is N/(N+1). Also, the combustion cylinder ratio is changed by changing the pattern such that the value of N is changed by one at a time.

With the above-described method, the cylinder deactivation interval is maintained constant while the combustion cylinder ratio is constant. Also, when changing the combustion cylinder ratio, the cylinder deactivation interval Changes only by the amount equivalent to one cylinder. Therefore, the above-described variable control method is capable of reducing engine speed fluctuation caused that is caused by changes in the cylinder deactivation interval when the variable control of the combustion cylinder ratio is performed.

To achieve the foregoing objective, another variable combustion cylinder ratio control method is provided that is adapted to variably control a combustion cylinder ratio of an engine during an intermittent deactivation operation, in which cylinder deactivation is intermittently performed. The method includes: when setting N to an integer greater than or equal to 1, repeatedly performing a cylinder deactivation in a pattern in which combustion is consecutively performed in N cylinders in the order of cylinders entering a combustion stroke, and then subsequent two consecutive cylinders are deactivated; and changing the combustion cylinder ratio by changing the pattern such that the value of N is changed by one at a time.

In this case also, the cylinder deactivation interval is maintained constant while the combustion cylinder ratio is constant. Also, when changing the combustion cylinder ratio, the cylinder deactivation interval changes only by the amount equivalent to one cylinder. Therefore, the above-described variable control method is also capable of reducing engine speed fluctuation caused by changes in the cylinder deactivation interval when the variable control of the combustion cylinder ratio is performed.

To achieve the foregoing objective, a variable combustion cylinder ratio control device is provided that is adapted to variably control a combustion cylinder ratio of an engine during an intermittent deactivation operation, in which cylinder deactivation is intermittently performed. The device includes a target ratio calculating section and a pattern determining section.

The target ratio calculating section is configured to calculate, as a target combustion cylinder ratio, a combustion cylinder ratio that is achievable by repeating cylinder deactivation at regular intervals. Thus, the value of the target combustion cylinder ratio can be changed by changing the cylinder deactivation interval by the amount equivalent to one cylinder at a time.

When an interval of cylinder deactivation from the cylinder deactivation at an interval at which a current combustion cylinder ratio is achieved to a subsequent cylinder deactivation is defined as a subsequent deactivation interval, the pattern determining section is configured to set the subsequent deactivation interval in the following manner. That is, when the target combustion cylinder ratio is the same as the current combustion cylinder ratio, the pattern determining section sets the subsequent deactivation interval to an interval at which the target combustion cylinder ratio can be achieved. Also, when the target combustion cylinder ratio is not the same as the current combustion cylinder ratio, the pattern determining section sets the subsequent deactivation interval to an interval that is closer, by an amount equivalent to one cylinder, to an interval at which the target combustion cylinder ratio can be achieved than the interval at which the current combustion cylinder ratio is achieved.

When the subsequent deactivation interval is set in this manner, the cylinder deactivation interval is maintained constant while the combustion cylinder ratio is constant, and even when the combustion cylinder ratio is changed, the cylinder deactivation interval is changed only by the amount equivalent to one cylinder at a time. Therefore, the above-described variable control device is capable of reducing engine speed fluctuation caused that is caused by changes in the cylinder deactivation interval when the variable control of the combustion cylinder ratio is performed.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 7 shows the order of combustion and deactivation of the cylinders.

FIG. 8 shows the order of combustion and deactivation of the cylinders.

DETAILED DESCRIPTION OF THE PREFERRED EMBODIMENTS

First Embodiment

A variable combustion cylinder ratio control method and a variable combustion cylinder ratio control device will now be described with reference to FIGS. 1 to 4. First, the structure of the variable control device of the present embodiment will be described with reference to FIG. 1.

Figure 1:
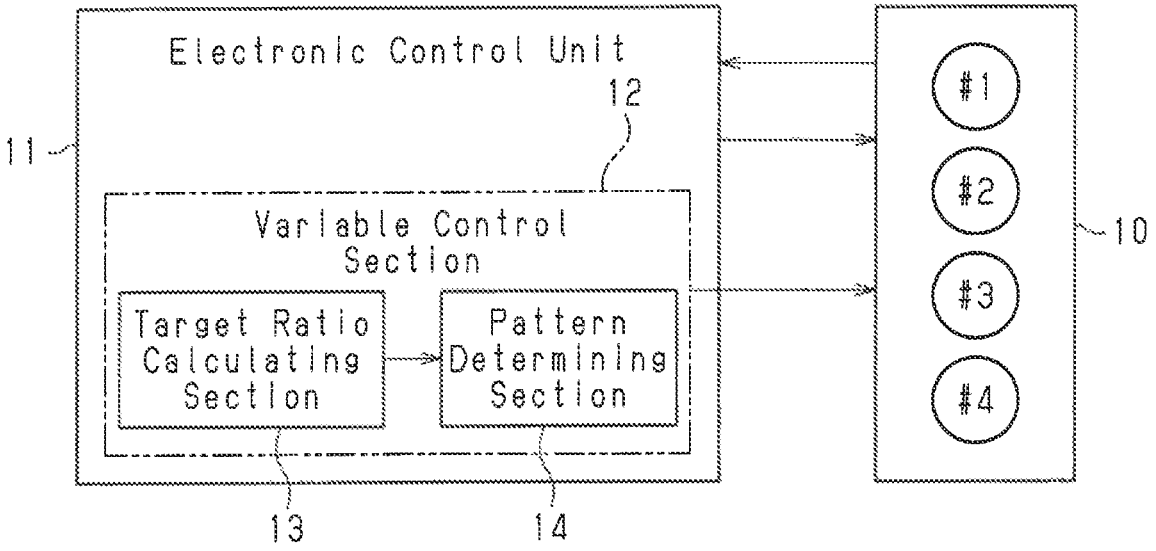
FIG. 1 is a diagram schematically showing the configuration of a variable combustion cylinder ratio control device according to a first embodiment.

An engine 10 shown in FIG. 1 includes four cylinders #1 to #4, which are arranged in-line. In the engine 10, ignition is performed in the order of the cylinder #1, the cylinder #3, the cylinder #4, and the cylinder #2.

The engine 10 is controlled by an electronic control unit 11. The electronic control unit 11 receives detection signals indicating, for example, the engine speed and the intake air amount detected by various sensors installed in the engine 10. Based on these detection signals, the electronic control unit 11 controls parameters related to the engine control such as the throttle opening degree, the fuel injection timing, the fuel injection amount, and the ignition timing of the engine 10.

The electronic control unit 11 also includes a variable control section 12, which variably controls the combustion cylinder ratio of the engine 10. The variable combustion cylinder ratio control device of the present embodiment is constituted by the variable control section 12. The combustion cylinder ratio represents the ratio of the number of the combustion cylinders to the total number of the combustion cylinders and the deactivated cylinders [Number of Combustion Cylinders/(Number of Combustion Cylinders Number of Deactivated Cylinders)]. The variable control of the combustion cylinder ratio is a control to change the combustion cylinder ratio of the engine 10 in accordance with the required output of the engine 10.

The variable control section 12 includes a target ratio calculating section 13 and a pattern determining section 14. The target ratio calculating section 13 calculates a target combustion cylinder ratio, which is a target value of the combustion cylinder ratio, in accordance with the operating state of the engine 10. The pattern determining section 14 determines a cylinder deactivation pattern of the engine 10 based on the target combustion cylinder ratio. The variable control section 12 controls the engine 10 such that cylinder deactivation is performed in accordance with the determined cylinder deactivation pattern.

Determination of Target Combustion Cylinder Ratio

The calculation of the target combustion cylinder ratio by the target ratio calculating section 13 will now be described. At a predetermined control cycle, the target ratio calculating section 13 reads in the rotational speed of the engine 10 (hereinafter, referred to as an engine speed) and the required torque of the engine 10, which has been obtained based on parameters such as the pressed amount of the accelerator pedal by the driver. The target ratio calculating section 13 calculates a target combustion cylinder ratio from the required torque and the engine speed.

Figure 2:
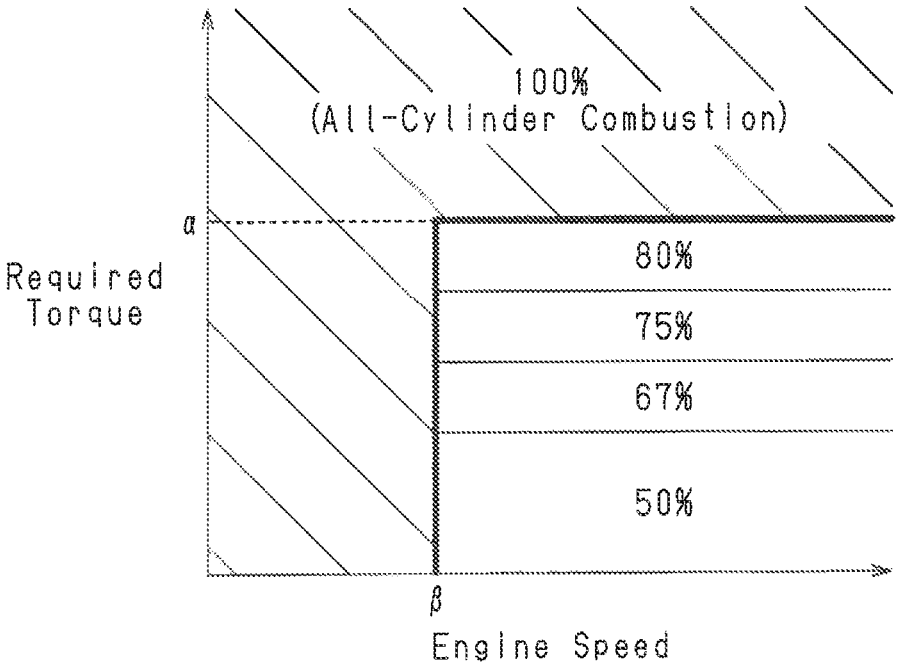
FIG. 2 is a graph showing the relationship between a target combustion cylinder ratio that is calculated by a target ratio calculating section provided in the variable control device, a required torque, and an engine speed.

FIG. 2 shows the relationship between the value of the target combustion cylinder ratio calculated by the target ratio calculating section 13, the required torque, and the engine speed. As shown in FIG. 2, the target combustion cylinder ratio is calculated to be one of 50%, 67%, 75%, 80%, and 100%.

As shown in FIG. 2, in the present embodiment, the target combustion cylinder ratio is fixed to 100% in the operation range of the engine 10 where the required torque exceeds a preset value $\alpha$. Also, even in the operation range of the engine 10 where the engine speed is lower than a preset value $\beta$, the target combustion cylinder ratio is fixed to 100%. When the combustion cylinder ratio is 100%, the engine 10 is operated at the all-cylinder combustion, at which combustion is performed in all the cylinders. In the engine 10 at this time, the required output is achieved by adjusting the flow rate of the air drawn into the cylinders (cylinder inflow air amount) in the intake strokes. Hereinafter, the operation range of the engine 10 where the engine 10 performs the all-cylinder combustion operation will be referred to as an all-cylinder combustion range.

In contrast, in the operation range where the required torque is less than or equal to the preset value α and the engine speed is greater than or equal to the preset value β, the target combustion cylinder ratio is changed in the range between 50% and 80% inclusive in accordance with the required torque. In this operation range, cylinder deactivation is performed intermittently to adjust the cylinder inflow air amount and change the combustion cylinder ratio, thereby achieving the required output of engine 10 Hereinafter, the operation range of the engine 10 where the engine 10 performs such intermittent cylinder deactivation will be referred to as an intermittent deactivation range.

The preset value α, which is the threshold value of the required torque dividing the all-cylinder combustion range and the intermittent deactivation range, is set to the maximum value of the engine torque that can be achieved even with the combustion cylinder ratio at 80%. In contrast, the preset value β, which is the threshold value of the engine speed that divides the all-cylinder combustion range and the intermittent deactivation range is set to a value described below. That is, when the engine 10 is in the intermittent deactivation operation, the engine speed temporarily drops each time cylinder deactivation is performed, so that vibration and noise are generated periodically at the cylinder deactivation interval. When the cylinder deactivation interval is the same, the lower the engine speed, the lower becomes the frequency of the vibration and noise associated with the cylinder deactivation. Vibrations and noises of frequencies lower than certain degrees tend to be perceived unpleasant by occupants. In this regard, the preset value β is set to the lower limit value of the engine speed at which the frequency of vibration and noise due to cylinder deactivation is not unpleasant for the occupants.

Determination of Cylinder Deactivation Pattern

Next, the determination of the cylinder deactivation pattern by the pattern determining section 14 will be described. FIG. 7 shows the order of combustion and deactivation of the cylinders for each value of the combustion cylinder ratio used in the variable control of the combustion cylinder ratio. As shown in FIG. 7, the variable control of the combustion cylinder ratio employs nine values of the combustion cylinder ratio: 0%, 50%, 67%, 75%, 80%, 83%, 66%, 88%, and 100%. The all-cylinder deactivation, at all the cylinders are deactivated as in the fuel cutoff operation and at stopping of idle corresponds to the combustion cylinder ratio of 0%.

Among the nine combustion cylinder ratios above, 0% is the ratio of the all-cylinder deactivation, and 100% is the ratio of the all-cylinder combustion. Accordingly, among the combustion cylinder ratios shown in FIG. 7, the ratios used during the intermittent deactivation operation of the engine 10 are seven values: 50%, 67%, 75%, 80%, 83%, 86%, and 88%. With each of these combustion cylinder ratios, the cylinder deactivation is repeatedly performed in a pattern in which combustion is consecutively performed in N cylinders (N being an integer greater than or equal to 1) in the order of the cylinders entering the combustion stroke, and then the subsequent cylinder is deactivated. That is, all the combustion cylinder ratios used during the intermittent deactivation operation are achievable by repeating cylinder deactivation in the above pattern, that is, by repeating cylinder deactivation at regular intervals. The combustion cylinder ratios of 50%, 67%, 75%, and 80%, which are calculated as the target combustion cylinder ratios during the intermittent deactivation operation by the target ratio calculating section 13, are also combustion cylinder ratios that are achievable by repeating cylinder deactivation at regular intervals.

In the present embodiment, each cylinder deactivation pattern is given an identification number (ID), the value of which is the number (N) of the cylinders in which combustion is consecutively performed in that pattern. Furthermore, in the present embodiment, the case where the combustion cylinder ratio is 0% (the all-cylinder deactivation) and the case where the combustion cylinder ratio is 100% (the all-cylinder combustion) are treated in the following manner are treated as follows for the purpose of facilitating the process at the time of transition from the all-cylinder combustion operation to the intermittent deactivation operation and from the all-cylinder deactivation operation to the intermittent deactivation operation in the cylinder deactivation pattern determining routine, which will be discussed below. That is, in the case of the combustion cylinder ratio of 0% (the all-cylinder deactivation), where only cylinder deactivation is repeated, the pattern with a single cylinder deactivation is defined as the cylinder deactivation pattern for the purpose of convenience, and the identification number of that pattern is set to 0. Also, in the case of the combustion cylinder ratio of 100%, where only combustion is repeated, the pattern with a single combustion is defined as the cylinder deactivation pattern for the purpose of convenience, and the identification number of that pattern is set to 8.

Furthermore, in the present embodiment, when the cylinder deactivation pattern is changed, the currently performed pattern is completed before the subsequent pattern is started from the beginning. Also, when the cylinder deactivation pattern is changed in the present embodiment, cylinder deactivation is performed at the end of the currently performed cylinder deactivation pattern before the subsequent cylinder deactivation pattern is started. Therefore, the cylinder deactivation patterns of the identification numbers 1 to 7 are set such that the cylinder at the end is deactivated. Furthermore, the cylinder deactivation pattern of the identification number 8 corresponds to the all-cylinder combustion, which includes no cylinder deactivation. The pattern of the identification number 8 is replaced, only immediately before being changed to another cylinder deactivation pattern, by a pattern in which one cylinder, after combustion in another cylinder, is deactivated.

Figure 3:
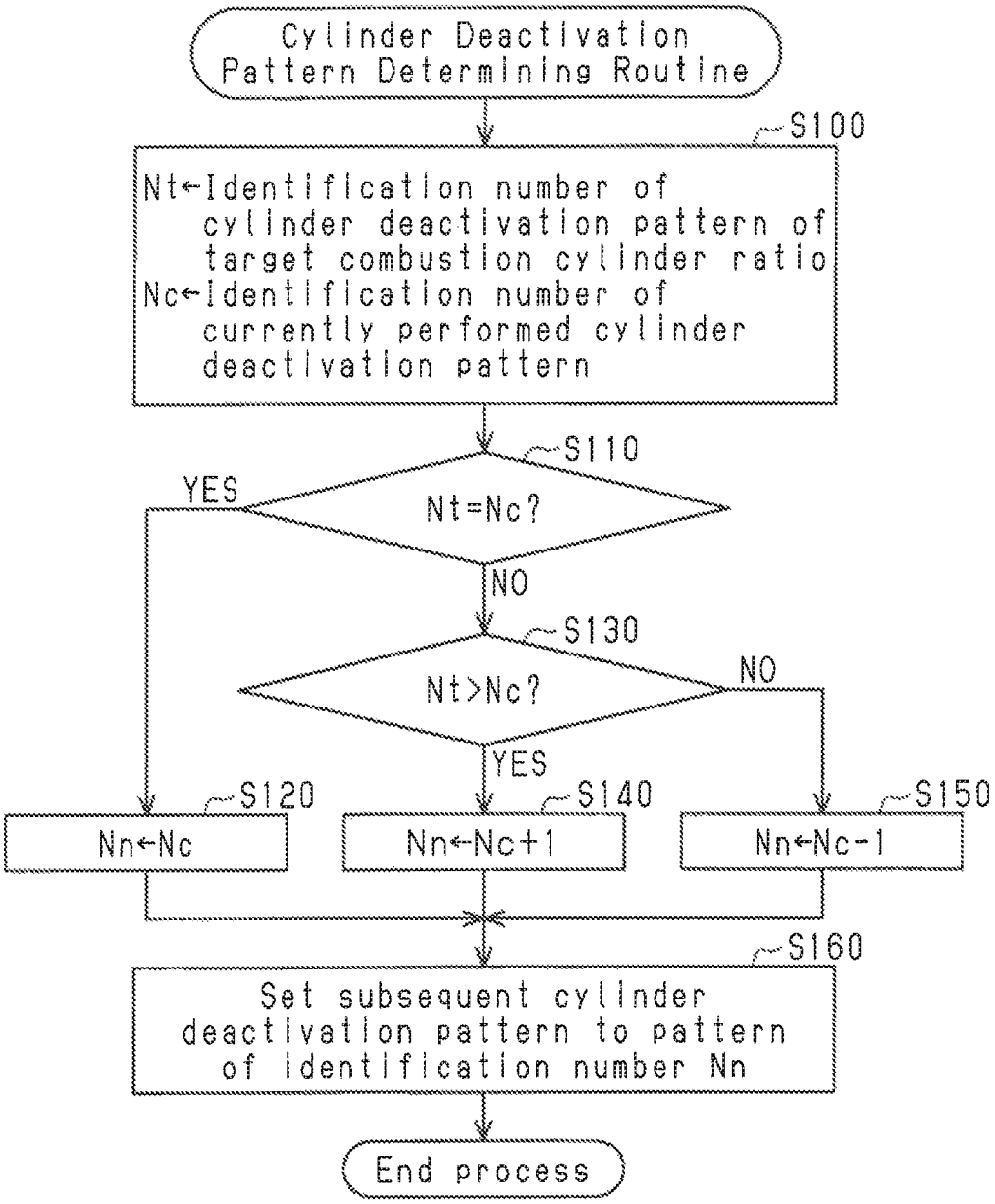
FIG. 3 is a flowchart of a cylinder deactivation pattern determining routine performed by a pattern determining section provided in the variable control device.

Based on the target combustion cylinder ratio calculated by the target ratio calculating section 13, the pattern determining section 14 selects one of the cylinder deactivation patterns of the identification numbers 0 to 8 as the pattern of the cylinder deactivation to be actually performed by the engine 10. FIG. 3 shows the flowchart of the cylinder deactivation pattern determining routine performed by the pattern determining section 14 in determining the cylinder deactivation pattern. The pattern determining section 14 executes the process of this routine at every combustion cycle of the engine 10.

As shown in FIG. 3, when this routine is started, in step S100, the pattern determining section 14 reads in the identification number of the cylinder deactivation pattern of the target combustion cylinder ratio calculated by the target ratio calculating section 13 (hereinafter, referred to as a target pattern Nt) and the identification number of the cylinder deactivation pattern that is currently performed in the engine 10 (hereinafter, referred to as a current pattern Nc). Subsequently, in step S110, the pattern determining section 14 determines whether the values of the target pattern Nt and the current pattern Nc are the same. The pattern determining section 14 advances the process to step S120 if the values are the same (YES) and advances the process to step S130 if the values are not the same (NO).

When the process is advanced to step S120, the pattern determining section 14 sets the value of the subsequent pattern Nn to the value of the current pattern Nc in step S120. Then, in step S160, the pattern determining section 14 sets a cylinder deactivation pattern of which the identification number is the value of the subsequent pattern Nn as the subsequent cylinder deactivation pattern, which will be performed after the current cylinder deactivation pattern. Then, the pattern determining section 14 ends the process of the current routine. That is, in this situation, the next cylinder deactivation will be performed in the same cylinder deactivation pattern as the current pattern.

In contrast, if the values of the current pattern Nc and the target pattern Nt are not the same (S110: NO) and the process is advanced to step S130, the pattern determining section 14 determines the magnitude relation of the values. If the value of the target pattern Nt is greater than the value of the current pattern Nc (S130: YES), the pattern determining section 14 adds 1 to the value of the current pattern Nc and sets the value of the subsequent pattern Nn to the resultant value (Nn←Nc+1) in step S140.

If the value of the target pattern Nt is less than the value of the current pattern Nc (S130: NO), the pattern determining section 14 subtracts 1 from the value of the current pattern Nc and sets the value of the subsequent pattern Nn to the resultant value (Nn←Nc−1) in step S150. In step S160, the pattern determining section 14 sets the cylinder deactivation pattern that will be performed next to the cylinder deactivation pattern of which the identification number is the value of the subsequent pattern Nn that has been set either in the step S140 or step S150. Then, the pattern determining section 14 ends the process of the current routine The interval of cylinder deactivation from the cylinder deactivation at the interval at which the current combustion cylinder ratio is achieved to the subsequent cylinder deactivation is defined as a subsequent deactivation interval. As described above, the cylinder deactivation patterns of the identification numbers 1 to 7, which are used in the intermittent deactivation operation, are set such that the cylinder at the end is deactivated. Therefore, the subsequent deactivation interval corresponds to the number of the combustion cylinders in the subsequent cylinder deactivation pattern, which will be performed after the current cylinder deactivation pattern.

In the cylinder deactivation pattern determining routine, when the identification number of the cylinder deactivation pattern corresponding to the target combustion cylinder ratio (the target pattern Nt) is the same as the identification number of the currently performed cylinder deactivation pattern (the current pattern Nc) (S110: YES), the currently performed cylinder deactivation will be continued in the next cycle. The case where the target pattern Nt is the same as the current pattern Nc refers to a case where the target combustion cylinder ratio is the same as the current combustion cylinder ratio, and the cylinder deactivation interval at this time is the interval at which the target combustion cylinder ratio can be achieved. Therefore, when the target combustion cylinder ratio is the same as the current combustion cylinder ratio, the pattern determining section 14 determines the cylinder deactivation pattern such that the subsequent deactivation interval is set to an interval at which the target combustion cylinder ratio achievable.

In contrast, when the target pattern. Nt is not the same as the current pattern Nc (S110: NO), the pattern determining section 14 adds one to or subtracts one from the value of the current pattern NC so that the value of the current pattern Nc approaches the target pattern NT and sets the resultant value as the identification number of the cylinder deactivation pattern that will be performed next. In such a case, the number of the combustion cylinders in the subsequent cylinder deactivation pattern will be closer by the amount equivalent to one cylinder to the number of the combustion cylinders of the cylinder deactivation pattern that achieves the target cylinder ratio than the number of the combustion cylinders of the current cylinder deactivation pattern. That is, the subsequent deactivation interval at this time is set to an interval that is closer, by the amount equivalent to one cylinder, to the interval at which the target combustion cylinder ratio can be achieved than the interval at which the current combustion cylinder ratio is achieved.

Operation and Advantages

Subsequently, the operation and advantages of the variable combustion cylinder ratio control method and device of the above-described embodiment will be described.

Figure 4:
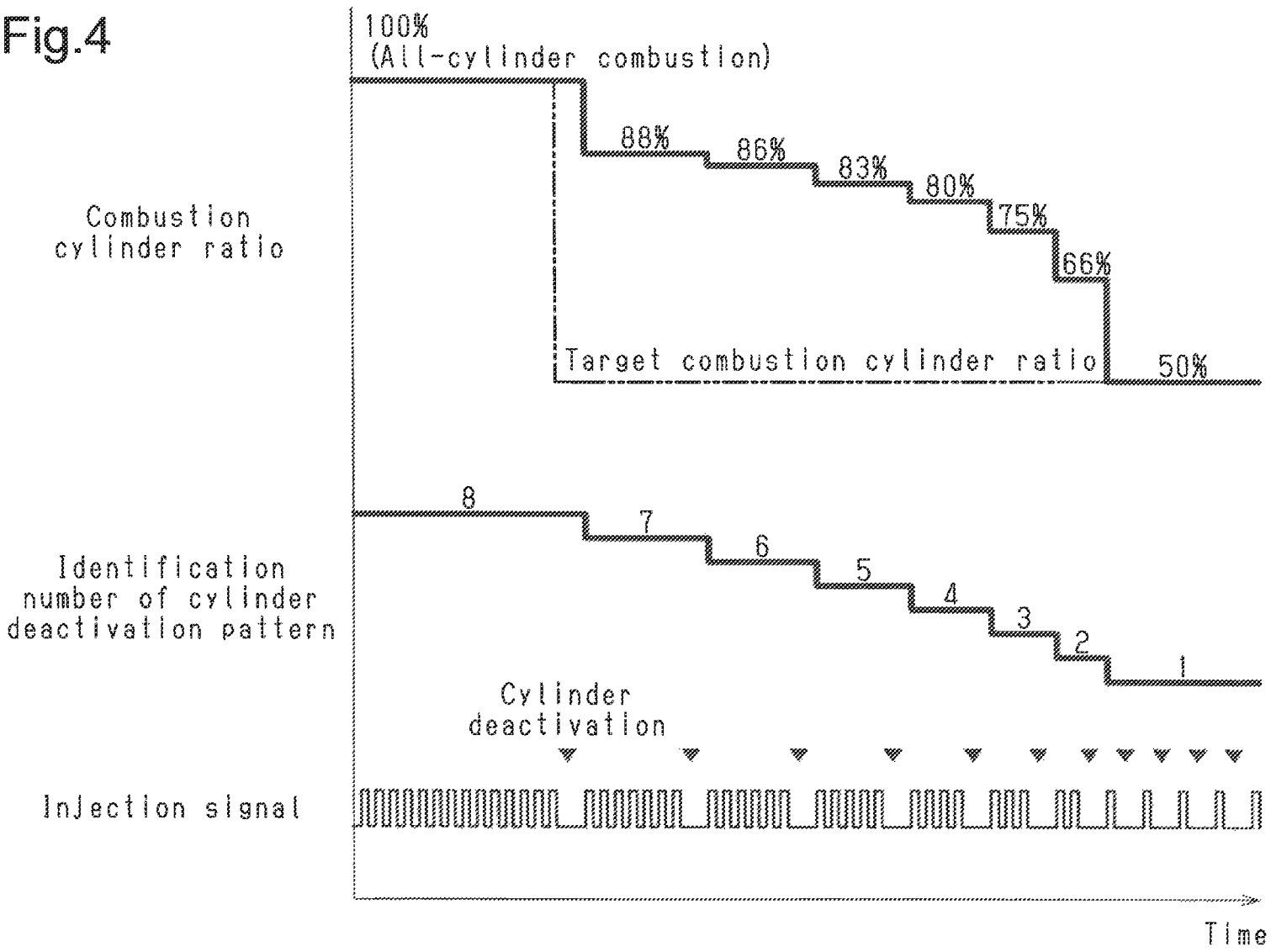
FIG. 4 is a time diagram showing one example of the manner in which the variable control of the combustion cylinder ratio according to the embodiment is performed.

FIG. 4 shows changes in the combustion cylinder ratio, cylinder deactivation pattern, and injection signal when the operation range of the engine 10 shifts from the all-cylinder combustion range to the range where the target combustion cylinder ratio in the intermittent deactivation range is 50%. The injection signal is a signal for instructing fuel injection to a cylinder when combustion is to be performed in that cylinder. In FIG. 4, a merged injection signal for the four cylinders #1 to #4 of the engine 10 is shown. Since the injection signal is not output when the cylinder deactivation is performed, a section where the pulse interval of the injection signal shown in FIG. 4 is longer than other sections is the section where the cylinder deactivation is performed.

When the target combustion cylinder ratio is changed from 100% to 50%, the cylinder deactivation pattern of the identification number 7, which corresponds to the combustion cylinder ratio of 88% is first performed, At this time, the engine 10 is switched from the all-cylinder combustion operation to the intermittent deactivation operation.

Thereafter, the cylinder deactivation patterns of the identification numbers 6 to 1 are performed in the order. Specifically, the cylinder deactivation pattern of the identification number 6, which corresponds to the combustion cylinder ratio of 86%, is performed once. Next, the cylinder deactivation pattern of the identification number 5, which corresponds to the combustion cylinder ratio of 83%, is performed once. Next, the cylinder deactivation pattern of the identification number 4, which corresponds to the combustion cylinder ratio of 80%, is performed once. Next, the cylinder deactivation pattern of the identification number 3, which corresponds to the combustion cylinder ratio of 75%, is performed once. Next, after the cylinder deactivation pattern of the identification number 2, which corresponds to the combustion cylinder ratio of 67%, is performed once, the cylinder deactivation pattern is changed to the pattern of the identification number 1, which corresponds to the combustion cylinder ratio of 50%, which is the target combustion cylinder ratio at this time. As described above, in each of the cylinder deactivation patterns of the identification numbers 1 to 7, the value of the identification number corresponds to the number of cylinders in which combustion is performed consecutively until the cylinder deactivation, that is, the cylinder deactivation interval. Thus, the change of the combustion cylinder ratio at this time is performed by sequentially changing the cylinder deactivation pattern such that the cylinder deactivation interval changes by the amount equivalent to one cylinder at a time.

Likewise, even when the value of the target combustion cylinder ratio is changed in the intermittent deactivation range, the combustion cylinder ratio is changed by changing the cylinder deactivation pattern such that the cylinder deactivation interval is changed by the amount equivalent to one cylinder at a time. In this manner, the change of the combustion cylinder ratio in the intermittent deactivation range is performed by sequentially changing the cylinder deactivation pattern such that the cylinder deactivation interval changes by the amount equivalent to one cylinder at a time.

When the operation range of the engine 10 shifts from the intermittent deactivation range to the all-cylinder combustion range, the cylinder deactivation pattern is changed sequentially such that the cylinder deactivation interval changes by the amount equivalent to one cylinder at a time until the cylinder deactivation pattern of the identification number 7, which corresponds to the combustion cylinder ratio of 88%, is reached. Then, after the cylinder deactivation pattern of the identification number 7 is performed, the operation is shifted to the cylinder deactivation pattern of the identification number 8, which corresponds to the combustion cylinder ratio of 100%, that is, to the all-cylinder combustion operation. In this case, even if the operation range of the engine 10 is in the all-cylinder combustion range, the intermittent deactivation operation is continued until the cylinder deactivation pattern of the identification number 7 is switched to the cylinder deactivation pattern of the identification number 8.

Further, in the above-described embodiment, when the combustion cylinder ratio is equal to the target combustion cylinder ratio, the cylinder deactivation pattern corresponding to the target combustion cylinder ratio is repeated. In this case, the cylinder deactivation interval is maintained constant.

In the present embodiment, the variable control of the combustion cylinder ratio is performed in the above-described manner. This variable control of the combustion cylinder ratio is achieved by changing the frequency of the cylinder deactivation during the intermittent deactivation operation of the engine 10. In the engine 10 during the intermittent deactivation operation, the engine speed temporarily drops in accordance with the cylinder deactivation and then rises in response to the combustion in a cylinder. The amount of increase in the engine speed at this time increases as the number of the combustion cylinders until the subsequent cylinder deactivation increases, that is, as the cylinder deactivation interval is prolonged. Therefore, if there are periods where the cylinder deactivation interval is long and periods where the cylinder deactivation interval is short, the fluctuation of the engine speed increases, In this regard, the present embodiment maintains the cylinder deactivation interval constant while the combustion cylinder ratio is maintained constant. Also, when changing the combustion cylinder ratio, the cylinder deactivation interval changes only by the amount equivalent to one cylinder. Therefore, it is possible to reduce the engine speed fluctuation caused by changes in the cylinder deactivation interval.

The fluctuation of the engine speed due to changes in the cylinder deactivation interval can be reduced by individual torque management for each cylinder. That is, by adjusting parameters such as the cylinder intake air amount and ignition timing of each cylinder, the amount of generated torque in each cylinder in which combustion is performed can be made greater in the section where the cylinder deactivation interval is short than in the cylinder deactivation interval is long. This, in turn, permits the amount of increase in the engine speed until the subsequent cylinder deactivation to be equalized. Accordingly, it is possible to suppress the fluctuation of the engine speed due to changes in the cylinder deactivation interval.

Even in the present embodiment, since the cylinder deactivation interval is also changed when changing the combustion cylinder ratio, individual torque management for each cylinder may be necessary to sufficiently suppress the speed fluctuation of the engine 10. Even in such a case, since the combustion cylinder ratio is changed by gradually changing the cylinder deactivation interval by the amount equivalent to one cylinder at a time in the present embodiment, the speed fluctuation of the engine 10 is suppressed by adjusting the torque generation by small steps.

The above-described embodiment may be modified as follows.

Even if the division of the all-cylinder combustion range and the intermittent deactivation range in the operation range of the engine 10 and the division of the target combustion cylinder ratio in the intermittent deactivation operation range may be different from those in FIG. 2.

In the above-illustrated embodiment, the seven patterns with cylinder deactivation intervals of one to seven cylinders are set as the cylinder deactivation patterns to be used when changing the combustion cylinder ratio in the variable control of the combustion cylinder ratio. If the number of the cylinders in the cylinder deactivation interval of each pattern is continuous, the number and types of such cylinder deactivation patterns may be changed as necessary.

Second Embodiment

Next, a variable combustion cylinder ratio control method and device according to a second embodiment will be described with reference to FIGS. 5 and 6.

Figure 5:
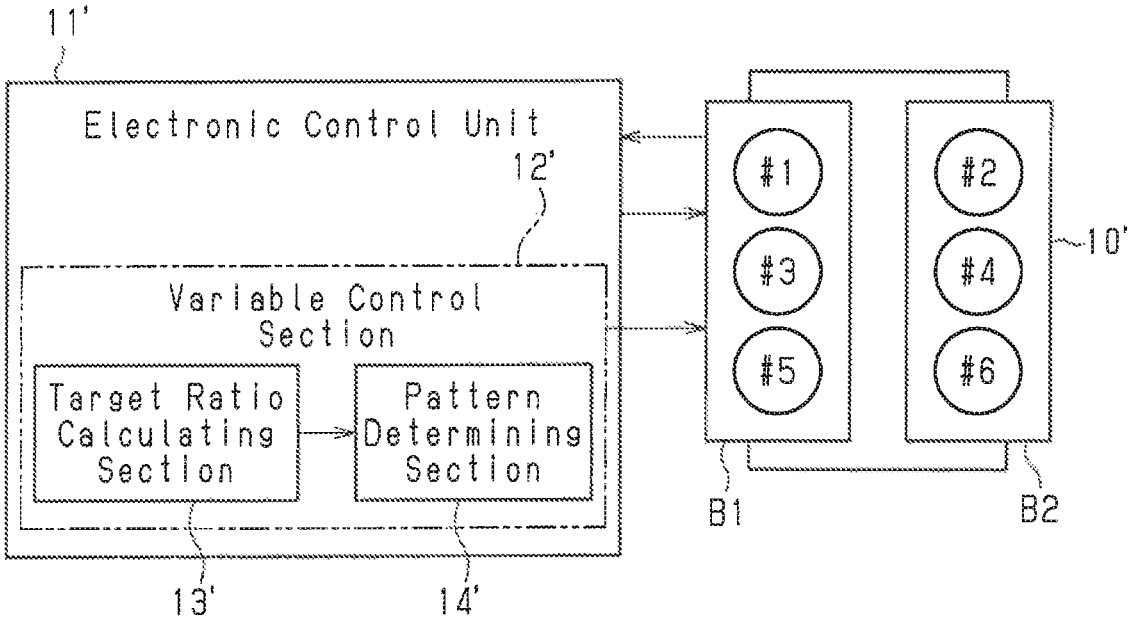
FIG. 5 is a diagram schematically showing the configuration of a variable combustion cylinder ratio control device according to a second embodiment.

As shown in FIG. 5, a variable control device of the present embodiment is applied to a V6 engine 10' having three cylinders in each of a first bank. B1 and a second bank B2. In the following description, the three cylinders provided in the first bank B1 are referred to as a cylinder #1, a cylinder #3, and a cylinder 45, respectively, and the three cylinders provided in the second bank B2 are referred to as a cylinder #2, a cylinder #4, and a cylinder #6. In the engine 10', ignition is performed in the order, of the cylinder #1, the cylinder #2, the cylinder #3, the cylinder #4, the cylinder 5, and the cylinder #6.

An electronic control unit 11', which controls the engine 10', has a variable control section 12', which serves as a variable combustion, cylinder ratio control device. The variable control section 12' includes a target ratio calculating section 13' and a pattern determining section 14'. The target ratio calculating section 13' calculates a target combustion cylinder ratio in accordance with the operating state of the engine 10'. The pattern determining section 14' determines a cylinder deactivation pattern of the engine 10' based on the target combustion cylinder ratio. The variable control section 12' controls the engine 10' such that cylinder deactivation is performed in accordance with the determined cylinder deactivation pattern.

Figure 6:
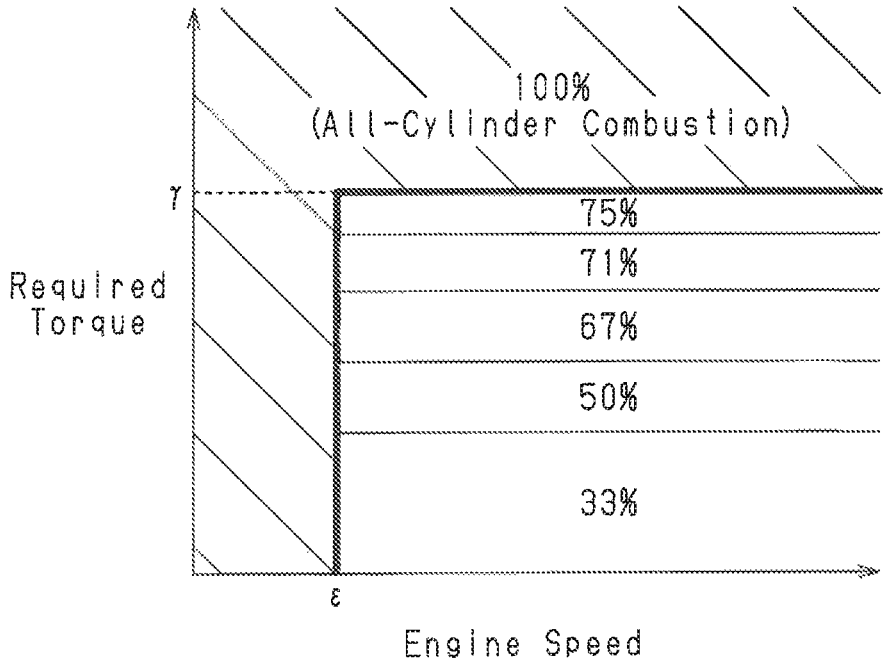
FIG. 6 is a graph showing the relationship between a target combustion cylinder ratio that is calculated by a target ratio calculating section provided in the variable control device, a required torque, and an engine speed.

FIG. 6 shows the relationship between the value of the target combustion cylinder ratio calculated by the target ratio calculating section 13', the required torque, and the engine speed. At a predetermined, control cycle, the target ratio calculating section 13' reads in the engine speed and the required torque and calculates the target combustion cylinder ratio from the engine speed and the required torque. As shown in FIG. 6, the target combustion cylinder ratio is calculated to be one of 33%, 50%, 67%, 71%, and 100% in the present embodiment. Specifically, the target combustion cylinder ratio is fixed to 100% in the operation range of the engine 10' where the required torque exceeds a preset value γ. Also, even in the operation range of the engine 10' where the engine speed is lower than a preset value ε, the target combustion cylinder ratio is fixed to 100%. In contrast, in the operation range of the engine 10' where the required torque is less than or equal to the preset value γ and the engine speed is greater than or equal to the preset value ε, the target combustion cylinder ratio is changed in the range between 33% and 75% inclusive in accordance with the required torque.

In the present embodiment also, a pattern determining section 14' determines the cylinder deactivation pattern of the engine 10' based on the target combustion cylinder ratio. In the present embodiment, the pattern determining section 14' selects one of the twelve-cylinder deactivation patterns shown in FIG. 8 as the cylinder deactivation pattern to be performed in the engine 10'.

As shown in FIG. 8, the twelve-cylinder deactivation patterns used in the present embodiment respectively correspond to the combustion cylinder ratio of 0%, 33%, 50%, 60%, 67%, 71%, 75%, 78%, 80%, 82% , 83%, and 100%. In the ten-cylinder deactivation patterns excluding the cylinder deactivation pattern corresponding to the combustion cylinder ratios of 0%, which represents the all-cylinder deactivation, and 100%, which represents the all-cylinder combustion, the cylinder deactivation is repeatedly performed in a pattern in which combustion is consecutively performed in N cylinders (N being an integer greater than or equal to 1) in the order of the cylinders entering the combustion stroke, and then the subsequent two consecutive cylinders are deactivated. That is, all the cylinder deactivation patterns used during the intermittent deactivation operation are ratios achievable by repeating cylinder deactivation in the above pattern, that is, by repeating cylinder deactivation at regular intervals.

In the present embodiment, each of the twelve-cylinder deactivation patterns is given an identification number (ID), the value of which is the number (N) of the cylinders in which combustion is consecutively performed in that pattern. Also, in the case the combustion cylinder ratio of 0% (the all-cylinder deactivation), the pattern with deactivation in two consecutive cylinders is defined as the cylinder deactivation pattern for the purpose of convenience, and the identification number of that pattern is set to 0. Also, in the present embodiment, in the case of the combustion cylinder ratio of 100% (the all-cylinder combustion), where only combustion is repeated, the pattern with combustion in two consecutive cylinders is defined as the cylinder deactivation pattern for the purpose of convenience, and the identification number of that pattern is set to 11.

Based on the target combustion cylinder ratio calculated by the target ratio calculating section 13, the pattern determining section 14° selects one of the cylinder deactivation patterns of the identification numbers 0 to 11 as the pattern of the cylinder deactivation to be actually performed by the engine 10'. The pattern determining section 14' of the present embodiment also determines the cylinder deactivation pattern according to the cylinder deactivation pattern determining routine of FIG. 3. That is, in the present embodiment also, change of the combustion cylinder ratio is performed by sequentially changing the cylinder deactivation pattern such that the identification number changes by one at a time. Also in the present embodiment, the value of the identification number of the cylinder deactivation pattern used during the intermittent deactivation operation corresponds to the cylinder deactivation interval when the corresponding cylinder deactivation pattern is repeated. Therefore, also in the present embodiment, when the target combustion cylinder ratio is the same as the current combustion cylinder ratio, the pattern determining section 14' sets the subsequent deactivation interval to an interval at which the target combustion cylinder ratio can be achieved. When the target combustion cylinder ratio is not the same as the current combustion cylinder ratio, the pattern determining section 14' sets the subsequent deactivation interval to an interval that is closer, by the amount equivalent to one cylinder, to the interval at which the target combustion cylinder ratio can be achieved than the interval at which the current combustion cylinder ratio is achieved.

In the present embodiment, which has the above-described configuration, the cylinder deactivation interval is maintained constant while the combustion cylinder ratio is maintained constant. Also, when changing the combustion cylinder ratio, the cylinder deactivation interval changes only by the amount equivalent to one cylinder. Therefore, the variable control method and the variable control device of the present embodiment are capable of reducing engine speed fluctuation caused by changes in the cylinder deactivation intervals when the variable control of the combustion cylinder ratio is performed.

A case will now be considered where an intermittent combustion operation is performed in V engine such that cylinder deactivation is repeated in a pattern in which combustion is consecutively performed in N cylinders and then the subsequent cylinder is deactivated. In such a case, if intermittent combustion is performed in a pattern in which the value of N is an odd number, the deactivated cylinders concentrate on one of the two banks. As a result, the exhaust properties of the two banks may be uneven, which may make the emission control difficult. To address this problem, the present embodiment consecutively performs combustion deactivation during the intermittent combustion operation for two cylinders at a time in the engine 10', in which the order of ignition is set so as to alternately perform combustion between the first bank B1 and the second bank B2. Thus, combustion is deactivated in one cylinder at a time in each of the first bank B1 and the second bank B2, which reduces the unevenness of the exhaust properties between the banks.

If a cylinder deactivation pattern that deactivates two consecutive cylinders is employed, the engine torque fluctuation during the intermittent combustion operation will be greater than in the case where a cylinder deactivation pattern that deactivates only one cylinder at a time is employed. The period during which engine torque is not generated when two consecutive cylinders are deactivated is 360° CA (crank angle) in a four-cylinder engine and 240° CA in a six-cylinder engine. Thus, the greater the number of the cylinders in the engine, the shorter becomes the period during which engine torque is not generated when two consecutive cylinders are deactivated. Therefore, in an engine with a large number of cylinders, it is easy to keep the engine torque fluctuation within an allowable range even if a cylinder deactivation pattern that deactivates two consecutive cylinders is employed.

In the above-described embodiments, the electronic control units 11, 11' are not limited to devices that include a central processing unit and a memory and executes all the above-described processes through software. For example, the electronic control units 11, 11' may include dedicated hardware (an application specific integrated circuit: ASIC) that executes at least part of the various processes. That is, the electronic control units 11, 11' may be circuitry including 1) one or more dedicated hardware circuits such as an ASIC, 2) one or more processors (microcomputers) that operate according to a computer program (software), or 3) a combination thereof.

The invention claimed is:

1. A variable combustion cylinder ratio control method for variably controlling a combustion cylinder ratio of an engine having a plurality of cylinders during an intermittent deactivation operation, in which cylinder deactivation is intermittently performed, the method comprising:

setting, to an integer greater than or equal to 1, a pattern ID (N) that always corresponds to a number of cylinders in which combustion is to be consecutively performed prior to deactivation of one cylinder of the cylinders or two consecutive cylinders of the cylinders;

repeatedly performing combustion and cylinder deactivation according to the pattern ID (N) and a firing order of the engine; and changing the pattern ID (N) by only one at a time to change the combustion cylinder ratio such that each intervening pattern ID (N) of one or more intervening pattern IDs (N) between a target pattern ID (N) and a current pattern ID (N) is performed only once while approaching the target pattern ID (N), wherein the pattern ID (N) can be set to one of at least four different pattern IDs (N).

2. A variable combustion cylinder ratio control method for variably controlling a combustion cylinder ratio of an engine during an intermittent deactivation operation, in which cylinder deactivation is intermittently performed, the method comprising:

when setting a variable N to an integer greater than or equal to 1, repeatedly performing a cylinder deactivation in a pattern in which combustion is consecutively performed in a number of cylinders that always matches the variable N in the order of the cylinders entering a combustion stroke, and then a subsequent one cylinder of the cylinders or a consecutive two cylinders of the cylinders are deactivated; and changing the combustion cylinder ratio by changing the pattern such that the value of the variable N is changed by only one at a time such that each intervening value of the variable N of one or more intervening values of the variable N between a target variable N and a current variable N is performed only once while approaching the target variable N, wherein the value of the variable N can be set to one of at least four different variables N.

3. A variable combustion cylinder ratio control device for variably controlling a combustion cylinder ratio of an engine during an intermittent deactivation operation, in which cylinder deactivation is intermittently performed, the control device comprising:

one or more electronic control units configured to:

calculate a target combustion cylinder ratio that is achievable by repeating cylinder deactivation at regular intervals, wherein a subsequent deactivation interval corresponds to a number of consecutive cylinders in which combustion occurs in a subsequent deactivation pattern that will be performed after a current cylinder deactivation pattern, and wherein the one or more electronic control units is configured such that:

when the target combustion cylinder ratio is the same as a current combustion cylinder ratio, the one or more electronic control units sets the subsequent deactivation interval to an interval at which the target combustion cylinder ratio can be achieved, and when the target combustion cylinder ratio is not the same as the current combustion cylinder ratio, the one or more electronic control units always sets the subsequent deactivation interval closer, by an amount equivalent to only one cylinder, to an interval at which the target combustion cylinder ratio can be achieved than to the interval at which the current combustion cylinder ratio is achieved such that each intervening interval of one or more intervening intervals between the interval at which the target combustion cylinder ratio can be achieved and the interval at which the current combustion cylinder ratio is achieved is performed only once while approaching the interval at which the target combustion cylinder ratio can be achieved, wherein the one or more electronic control units can set the subsequent deactivation interval to one of at least four different subsequent deactivation patterns.

* * * * *